US009163529B2

(12) United States Patent
Yamada

(10) Patent No.: US 9,163,529 B2
(45) Date of Patent: Oct. 20, 2015

(54) BOILER SYSTEM

(71) Applicant: MIURA CO., LTD., Ehime (JP)

(72) Inventor: Kazuya Yamada, Ehime (JP)

(73) Assignee: MIURA CO., LTD., Matsuyama-Shi, Ehime (JP)

( * ) Notice: Subject to any disclaimer, the term of this patent is extended or adjusted under 35 U.S.C. 154(b) by 0 days.

(21) Appl. No.: 14/416,225

(22) PCT Filed: Feb. 28, 2013

(86) PCT No.: PCT/JP2013/055340
§ 371 (c)(1),
(2) Date: Jan. 21, 2015

(87) PCT Pub. No.: WO2014/125652
PCT Pub. Date: Aug. 21, 2014

(65) Prior Publication Data

US 2015/0184548 A1 Jul. 2, 2015

(30) Foreign Application Priority Data

Feb. 15, 2013 (JP) ..... 2013-027484

(51) Int. Cl.
*F22B 37/42* (2006.01)
*F01K 13/02* (2006.01)
*F22B 35/00* (2006.01)

(52) U.S. Cl.
CPC ..... *F01K 13/02* (2013.01); *F22B 35/00* (2013.01); *F22B 35/008* (2013.01)

(58) Field of Classification Search
CPC .... F22B 35/008; F22D 5/36; F24D 2200/043
USPC ..... 700/275, 276
See application file for complete search history.

(56) References Cited

U.S. PATENT DOCUMENTS

| | | | | |
|---|---|---|---|---|
| 5,172,654 | A * | 12/1992 | Christiansen | 122/448.3 |
| 7,819,334 | B2 * | 10/2010 | Pouchak et al. | 237/8 R |
| 8,479,689 | B2 * | 7/2013 | Pitonyak et al. | 122/448.3 |
| 8,677,947 | B2 * | 3/2014 | Ookubo et al. | 122/448.3 |
| 8,888,011 | B2 | 11/2014 | Miura et al. | |
| 8,965,584 | B2 * | 2/2015 | Deivasigamani et al. | 700/275 |
| 2012/0006285 | A1 | 1/2012 | Miura et al. | |

FOREIGN PATENT DOCUMENTS

| | | | |
|---|---|---|---|
| CN | 102313276 | A | 1/2012 |
| JP | H3-158601 | A | 7/1991 |

(Continued)

*Primary Examiner* — Gregory A Wilson
(74) *Attorney, Agent, or Firm* — Muncy, Geissler, Olds & Lowe, P.C.

(57) ABSTRACT

A boiler system includes a boiler group provided with a plurality of boilers and a controller for controlling a combustion state of the boiler group. The boiler group has a varied steam flow set to indicate reserve power corresponding to expected increase of a steam flow due to a sudden variation of a required load, and an increase minimum load factor set to indicate a load factor for output of a steam flow corresponding to the required load only from the combusting boilers with no increase of the number of combusted boilers. The controller increases the number of the combusted boilers when a total reserve steam flow of the combusting boilers is not more than the varied steam flow and the load factor of each of the combusting boilers is not lower than the increase minimum load factor.

2 Claims, 7 Drawing Sheets

(56) References Cited

FOREIGN PATENT DOCUMENTS

| | | | |
|---|---|---|---|
| JP | H11-132405 | A | 5/1999 |
| JP | 2002-130602 | | 5/2002 |
| JP | 2002-130604 | | 5/2002 |
| JP | 2002-228102 | | 8/2002 |

* cited by examiner

Necessary steam flow: increased

| | |
|---|---|
| Varied steam flow | 10000kg/h |
| Total reserve steam flow | 10500kg/h |
| Steam supply preparing steam flow | – |
| Increase minimum load factor | 50% |
| Load factor (Combusting boiler) | 25% |

| | |
|---|---|
| Varied steam flow | 10000kg/h |
| Total reserve steam flow | 9800kg/h |
| Steam supply preparing steam flow | 7000kg/h |
| Increase minimum load factor | 50% |
| Load factor (Combusting boiler) | 30% |

BOILER SYSTEM

CROSS REFERENCE TO RELATED APPLICATIONS

This application is a 371 National Stage of PCT/JP2013/055340, filed on Feb. 28, 2013, for which priority is claimed under 35 U.S.C. §120; and this application claims priority of Application No. 2013-027484 filed in Japan on Feb. 15, 2013 under 35 U.S.C. §119; the entire contents of all of which are hereby incorporated by reference.

TECHNICAL FIELD

The present invention relates to a boiler system. The present invention relates more particularly to a boiler system for proportionally controlling a combustion state.

BACKGROUND ART

Conventionally proposed boiler systems for combusting a plurality of boilers to generate steam include a boiler system of the so-called proportional control type, for continuously increasing or decreasing a boiler combustion amount to control a steam flow (e.g. Patent Document 1). Such a boiler system of the proportional control type can finely regulate the generated steam flow and improve pressure stability.

A boiler system typically secures, as reserve power, a steam flow approximately corresponding to a sudden load variation or temporary increase of a necessary steam flow. Reserve power can be secured most easily by increasing the number of combusted boilers.

PRIOR ART DOCUMENT

Patent Document

Patent Document 1: JP 11-132405 A

SUMMARY OF INVENTION

Problem to be Solved by Invention

Even in the boiler system of the proportional control type, the boilers need to be started or stopped by ON/OFF control. A started or stopped boiler has a load factor varied largely. When the number of combusted boilers is increased or decreased repeatedly, continuous control of the proportional control type may not be exerted and pressure stability may thus deteriorate.

Regarding this point, in order to secure a sufficient amount of reserve power with a small number of combusting boilers, the number of boilers is increased when a load factor reaches a minimum load factor for the increased number of boilers as depicted in FIG. 7. Each of the boilers of the increased number combusts at the minimum load factor in such a state. When the load decreases subsequently, the increased boiler is stopped shortly and the boiler is started and stopped repeatedly. As a result, the advantage of the proportional control type is not exerted (i.e. failing to secure a fixed number of boilers operating zone of operating a fixed number of boilers) and pressure stability thus deteriorates.

In view of the above, a first object of the present invention is to provide a boiler system that can improve pressure stability with no repeated start and stop of a boiler, and a second object thereof is to provide a boiler system that can improve pressure stability as well as secure reserve power for a sudden load variation or temporary increase of a necessary steam flow.

Solution to Problem

The present invention relates to a boiler system including a boiler group provided with a plurality of boilers configured to combust at continuously changing load factors, and a controller for controlling a combustion state of the boiler group in accordance with a required load, wherein the boiler group has a varied steam flow set to indicate reserve power corresponding to expected increase of a steam flow due to a sudden variation of the required load, and an increase minimum load factor set to indicate a load factor for output of a steam flow corresponding to the required load only from the combusting boilers with no increase of combusted boilers, the controller includes a reserve power calculator for calculating, as a reserve steam flow, a difference between a maximum steam flow and an output steam flow for each of the combusting boilers out of the plurality of boilers and calculating, as a total reserve steam flow, a sum of the reserve steam flows thus obtained, a load factor calculator for calculating the load factor of each of the combusting boilers out of the plurality of boilers, and a boiler number controller for increasing the number of the combusted boilers when the total reserve steam flow calculated by the reserve power calculator is not more than the varied steam flow and the load factor calculated by the load factor calculator is not lower than the increase minimum load factor.

Preferably, the boiler number controller shifts, from a combustion stopped state to a steam supply preparing state, the boilers of the number corresponding to a difference between the varied steam flow and the total reserve steam flow when the total reserve steam flow becomes not more than the varied steam flow before the load factor of each of the combusting boilers becomes not lower than the increase minimum load factor.

Effect of Invention

The present invention achieves improvement in pressure stability with no repeated start and stop of a boiler. The present invention also achieves improvement in pressure stability as well as securing reserve power for a sudden load variation or temporary increase of a necessary steam flow.

DESCRIPTION OF EMBODIMENTS

A boiler system according to a preferred embodiment of the present invention will now be described with reference to the drawings.

Figure 1:
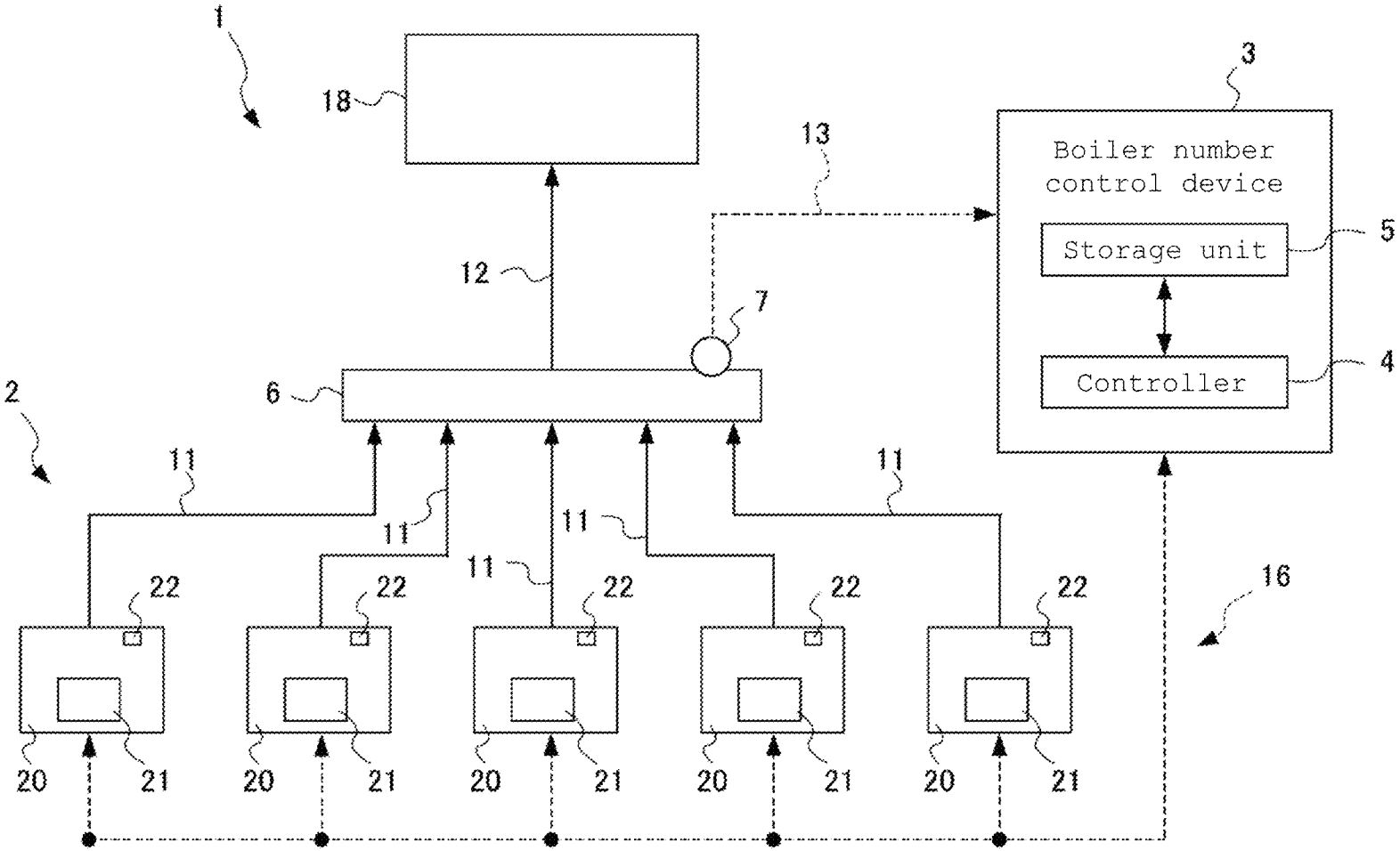
FIG. 1 is a schematic diagram of a boiler system according to an embodiment of the present invention.

An entire configuration of a boiler system 1 according to the present invention is described initially with reference to FIG. 1.

The boiler system 1 includes a boiler group 2 having a plurality of (five) boilers 20, a steam header 6 for collecting steam generated by the plurality of boilers 20, a steam pressure sensor 7 for measuring internal pressure of the steam header 6, and a boiler number control device 3 having a controller 4 for controlling a combustion state of the boiler group 2.

The boiler group 2 includes the plurality of boilers 20 and generates steam to be supplied to a steam utilizing apparatus 18 serving as a loading machine.

Each of the boilers 20 is electrically connected to the boiler number control device 3 through a signal wire 16. The boilers 20 each include a boiler body 21 for performing combustion, and a local controller 22 for controlling a combustion state of the corresponding boiler 20.

The local controller 22 changes the combustion state of the boiler 20 in accordance with a required load. Specifically, the local controller 22 controls the combustion state of the boiler 20 in accordance with a boiler number control signal transmitted from the boiler number control device 3 through the signal wire 16. The local controller 22 also transmits a signal to be utilized by the boiler number control device 3, to the boiler number control device 3 through the signal wire 16. Examples of the signal utilized by the boiler number control device 3 include data on an actual combustion state of the boiler 20, and other data.

The steam header 6 is connected, through a steam pipe 11, to each of the boilers 20 configuring the boiler group 2. The steam header 6 has a downstream end connected to the steam utilizing apparatus 18 through a steam pipe 12.

The steam header 6 collects and stores steam generated by the boiler group 2 to regulate relative pressure differences and pressure variations of the plurality of boilers 20 and supply pressure regulated steam to the steam utilizing apparatus 18.

The steam pressure sensor 7 is electrically connected to the boiler number control device 3 through a signal wire 13. The steam pressure sensor 7 measures internal steam pressure (pressure of steam generated by the boiler group 2) of the steam header 6 and transmits a signal on the measured steam pressure (steam pressure signal) to the boiler number control device 3 through the signal wire 13.

The boiler number control device 3 controls the combustion state of each of the boilers 20 in accordance with the internal steam pressure of the steam header 6 measured by the steam pressure sensor 7. The boiler number control device 3 includes the controller 4 and a storage unit 5.

The controller 4 controls the combustion states and priority levels to be described later of the five boilers 20 by issuing various commands to the boilers 20 through the signal wire 16 and receiving various data from the boilers 20. The local controller 22 in each of the boilers 20 controls the corresponding boiler 20 in accordance with a command signal for a change of a combustion state received from the boiler number control device 3.

The storage unit 5 stores information such as the content of a command issued to each of the boilers 20 according to control of the boiler number control device 3 (controller 4) or a combustion state received from each of the boilers 20, information such as a setting condition of the combustion pattern of the boilers 20, setting information on the priority levels of the boilers 20, setting information on changes of the priority levels (rotation), and the like.

The boiler system 1 thus configured can supply steam generated by the boiler group 2 to the steam utilizing apparatus 18 through the steam header 6.

A load required at the boiler system 1 (required load) corresponds to a consumed steam flow at the steam utilizing apparatus 18. The boiler number control device 3 calculates a variation of the internal steam pressure of the steam header 6 according to a variation of the consumed steam flow from the internal steam pressure (physical quantity) of the steam header 6 measured by the steam pressure sensor 7 to control a combustion amount of each of the boilers 20 configuring the boiler group 2.

Specifically, the required load (consumed steam flow) is increased by increase of a demand from the steam utilizing apparatus 18, and the internal steam pressure of the steam header 6 is decreased by shortage of a steam flow (output steam flow to be described later) supplied to the steam header 6. In contrast, the required load (consumed steam flow) is decreased by decrease of the demand from the steam utilizing apparatus 18, and the internal steam pressure of the steam header 6 is increased by excess of the steam flow supplied to the steam header 6. The boiler system 1 can thus monitor a variation of the required load according to the variation of the steam pressure measured by the steam pressure sensor 7. The boiler system 1 calculates a necessary steam flow from the steam pressure of the steam header 6. The necessary steam flow corresponds to a steam flow needed in accordance with the consumed steam flow (required load) at the steam utilizing apparatus 18.

Figure 2:
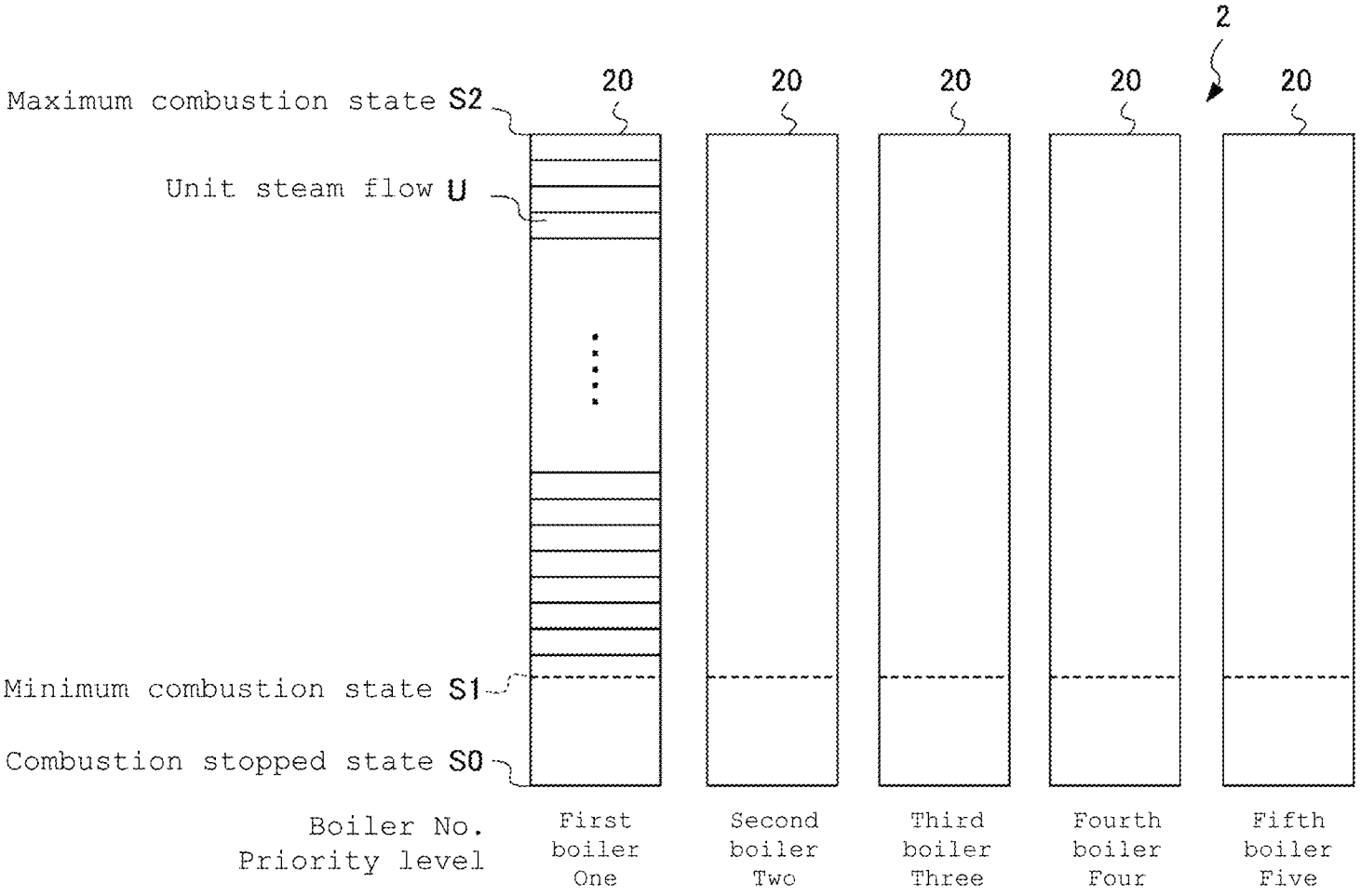
FIG. 2 is a schematic diagram of a boiler group according to an embodiment of the present invention.

The plurality of boilers 20 configuring the boiler system 1 according to the present embodiment is described below. FIG. 2 is a schematic diagram of the boiler group 2 according to the present embodiment.

The boilers 20 according to the present embodiment are configured as proportional control boilers that can each combust with a continuously changed load factor.

A proportional control boiler has a combustion amount that can be controlled continuously at least in a range from a minimum combustion state S1 (e.g. a combustion state with a combustion amount corresponding to 20% of a maximum combustion amount) to a maximum combustion state S2. The combustion amount of the proportional control boiler is regulated by control of an opening degree (combustion ratio) of a valve used for supplying fuel to a burner or a valve used for supplying combustion air.

Continuous control of a combustion amount includes a case where output from the boiler 20 (combustion amount) can be controlled actually continuously even when the local controller 22 performs calculation or utilizes a signal digitally and in a stepwise manner (e.g. when the output is controlled by the percentage.)

According to the present embodiment, a change of the combustion state between a combustion stopped state S0 and the minimum combustion state S1 of the boiler 20 is controlled by performing/stopping combustion of the boiler 20 (burner). The combustion amount can be controlled continuously in the range from the minimum combustion state S1 to the maximum combustion state S2.

More specifically, each of the boilers 20 has a unit steam flow U, which is set as the unit of a variable steam flow. The steam flow of each of the boilers 20 can be thus changed by the unit steam flow U in the range from the minimum combustion state S1 to the maximum combustion state S2.

The unit steam flow U can be set appropriately in accordance with the steam flow in the maximum combustion state S2 (maximum steam flow) of the boiler 20. In order for improvement in followability of an output steam flow to a necessary steam flow in the boiler system 1, the unit steam flow U is set preferably at 0.1% to 20% of the maximum steam flow of the boiler 20 and more preferably at 1% to 10% thereof.

An output steam flow corresponds to a steam flow outputted from the boiler group 2 and is obtained as the sum of the steam flows outputted from the plurality of boilers 20.

The boiler group 2 has a stop reference threshold and an increase reference threshold that are set for determination of the number of the combusted boilers 20. According to the present embodiment, the stop reference threshold corresponds to a boiler number decreasing load factor and the increase reference threshold corresponds to a varied steam flow and an increase minimum load factor.

The boiler number decreasing load factor is a reference load factor for stopping one of the combusting boilers 20. When the load factors of the combusting boilers 20 are not higher than (are equal to or lower than) the boiler number decreasing load factor, more particularly when the load factors of the combusting boilers 20 are not higher than the boiler number decreasing load factor continuously for a predetermined period, one of the combusting boilers 20 is stopped. The boiler number decreasing load factor can be set appropriately. In order to simplify the disclosure, the load factor (20%) corresponding to the minimum combustion state S1 is set as the boiler number decreasing load factor in the present embodiment.

The varied steam flow is provided as reserve power to be briefly increased correspondingly to a sudden load variation. An increase minimum load factor is provided as a load factor for output of a steam flow corresponding to a required load from only the combusting boilers 20 with no increase of the number of the combusted boilers 20.

As to be described later, the boiler group 2 is controlled such that a sum of reserve power of the combusting boilers 20 (a total reserve steam flow to be mentioned later) exceeds the varied steam flow. Specifically, when the total reserve steam flow to be described later is not more than (is equal to or less than) the set varied steam flow, more particularly when the total reserve steam flow is not more than the varied steam flow continuously for a predetermined period, the boiler group 2 is controlled to secure reserve power corresponding to the varied steam flow. Reserve power is secured most easily by increasing the number of the combusted boilers 20. According to the present embodiment, the number of the combusted boilers 20 is not increased until the load factors of the combusting boilers 20 are not lower than (is equal to or higher than) the increase minimum load factor, more particularly until the load factors of the combusting boilers 20 are not lower than the increase minimum load factor continuously for a predetermined period. In other words, according to the present embodiment, the number of the combusted boilers 20 is increased when the total reserve steam flow to be described later is not more than the varied steam flow and the load factors of the combusting boilers 20 are not lower than the increase minimum load factor continuously for a predetermined period.

The plurality of boilers 20 has the respective priority levels. The priority levels are utilized for selection of the boiler 20 that receives a combustion command or a combustion stop command. The priority levels are each set to have an integer value such that a smaller value indicates a higher priority level. As depicted in FIG. 2, when the boilers 20 include first to fifth boilers that have the priority levels of "one" to "five", respectively, the first boiler has the highest priority level whereas the fifth boiler has the lowest priority level. These priority levels are normally controlled by the controller 4 to be described later and are changed at predetermined time intervals (e.g. every 24 hours).

Control by the boiler number control device 3 according to the present embodiment is described in detail below.

Figure 3:
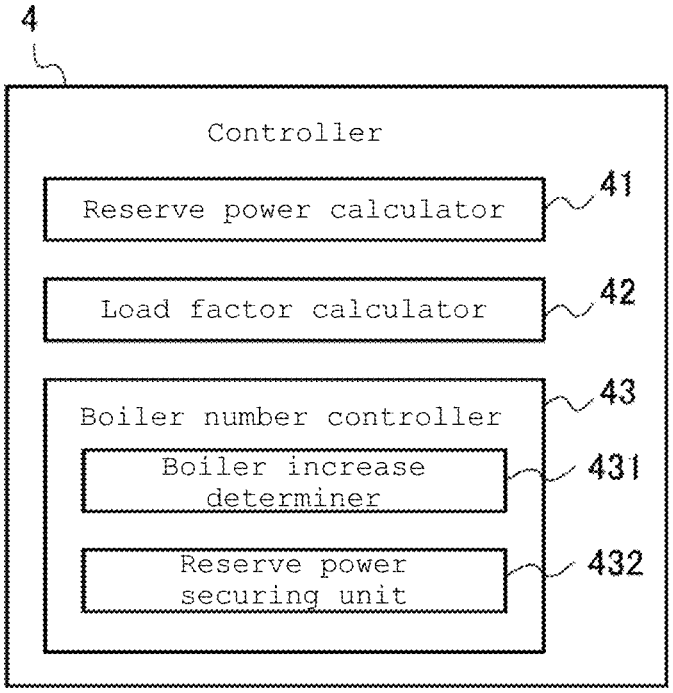
FIG. 3 is a functional block diagram depicting a configuration of a controller.

The boiler number control device 3 according to the present embodiment controls the boiler group 2 so as to secure reserve power for a sudden load variation or temporary increase of a necessary steam flow as well as improve pressure stability by continuous control unique to a proportional control boiler. As depicted in FIG. 3, the controller 4 includes a reserve power calculator 41, a load factor calculator 42, and a boiler number controller 43.

The reserve power calculator 41 calculates, as a reserve steam flow, a difference between the maximum steam flow and a steam flow outputted from each of the combusting boilers 20 (i.e. reserve power of the corresponding boiler 20). The reserve power calculator 41 also calculates, as a total reserve steam flow, the sum of the reserve steam flows of the combusting boilers 20 (i.e. reserve power of the boiler group 2).

The load factor calculator 42 calculates a load factor of the combusting boiler 20 out of the plurality of boilers 20. A load factor can be calculated by any method, from a ratio of a steam flow outputted from the boiler 20 to the maximum steam flow, from a combustion command to the boiler 20, or the like.

The boiler number controller 43 determines the number of the combusted boilers 20 in accordance with the stop reference threshold and the increase reference threshold, and controls the boiler group 2 so as to combust the determined number of the boilers 20. The boiler system 1 according to the present invention is characterized in increase of the number of the combusted boilers 20, and the boiler number controller 43 thus includes a boiler increase determiner 431.

The boiler increase determiner 431 determines whether or not the number of the combusted boilers 20 needs to be increased in accordance with the increase reference threshold. Specifically, the boiler increase determiner 431 determines that the number of the combusted boilers 20 needs to be increased when the total reserve steam flow is not more than the varied steam flow and the load factors of the combusting boilers 20 are not lower than the increase minimum load factor continuously for a predetermined period.

When the boiler increase determiner 431 determines that the number of the combusted boilers 20 needs to be increased, the boiler number controller 43 causes the boiler 20 of the highest priority level out of the combustion stopped boilers 20 to start combustion so as to increase the number of the combusted boilers 20.

According to determination by the boiler increase determiner 431, the number of the combusted boilers 20 is not increased until the load factors become not lower than the increase minimum load factor even if reserve power corresponding to the varied steam flow is not secured. Sufficient reserve power cannot be secured in this case. The boiler number controller 43 thus includes a reserve power securing unit 432 as well as the boiler increase determiner 431.

The reserve power securing unit 432 shifts, from the combustion stopped state to a steam supply preparing state, the boilers 20 of the number corresponding to a difference between the varied steam flow and the total reserve steam flow when the total reserve steam flow becomes not more than the varied steam flow before the load factors of the combusting boilers 20 become not lower than the increase minimum load factor. In other words, the reserve power securing unit 432 secures reserve power corresponding to the varied steam flow not by increasing the number of the combusted boilers 20 but by shifting the combustion stopped boilers 20 to the steam supply preparing state. In the steam supply preparing state, steam is not supplied but pressure is kept.

Figure 4:
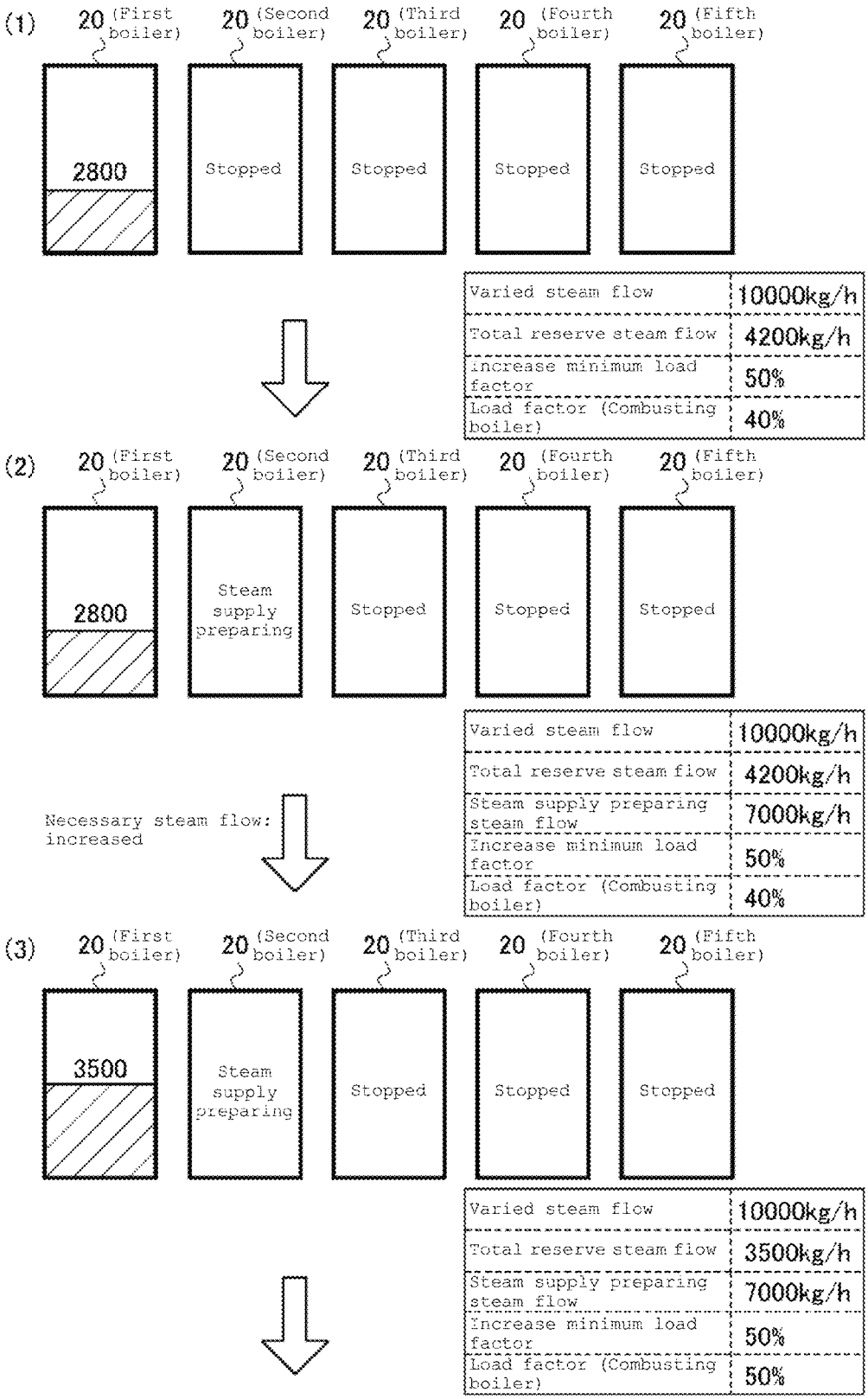
FIGS. 4(1) to 4(3) are schematic views exemplifying operation of the boiler system.

A specific example of operation of the boiler system 1 according to the present invention is described next with reference to FIGS. 4(1) to 5(5). FIGS. 4(1) to 5(5) are views each schematically depicting a combustion state of the boiler group 2.

The boilers 20 in FIGS. 4(1) to 5(5) are each assumed to be a seven-ton boiler having the capacity of 7000 kg, the varied steam flow of 10000 kg/h, and the increase minimum load factor of 50%.

With reference to FIG. 4(1), the first boiler is combusting at the load factor of 40%, whereas the second to fourth boilers are stopped. The first boiler is combusting at the load factor of 40%, and the total reserve steam flow is thus 4200 kg/h in this case. Reserve power corresponding to the varied steam flow is not secured continuously for a predetermined period in FIG. 4(1). The increase minimum load factor is 50%, and the load factor of 40% of the combusting first boiler is lower than the increase minimum load factor.

The controller 4 thus secures reserve power corresponding to the varied steam flow not by increasing the number of the combusted boilers 20 but by shifting the boiler 20 of the highest priority level out of the combustion stopped boilers 20 to the steam supply preparing state. In FIG. 4(2), the second boiler is brought into the steam supply preparing state in order for securing reserve power exceeding the varied steam flow by adding the total reserve steam flow of the combusting first boiler.

When the necessary steam flow is subsequently increased in accordance with a required load, the load factor of the combusting first boiler is increased so that the output steam flow follows the necessary steam flow. The load factor of the first boiler is increased from 40% to 50% in FIG. 4(3). The increase minimum load factor is 50% in this state, and the load factor of the combusting boiler 20 is not lower than the increase minimum load factor. The total reserve steam flow of the combusting boiler 20 (first boiler) is 3500 kg/h. Reserve power corresponding to the varied steam flow is not secured only by the combusting boiler 20.

When the state depicted in FIG. 4(3) lasts for a predetermined period, the controller 4 increases the number of the combusted boilers 20. The controller 4 causes the boiler 20 of the highest priority level out of the combustion stopped boilers 20 to start combustion. When any one of the boilers 20 is in the steam supply preparing state, this boiler 20 has the highest priority level. The controller 4 thus causes the boiler 20 in the steam supply preparing state to start combustion.

Figure 5:
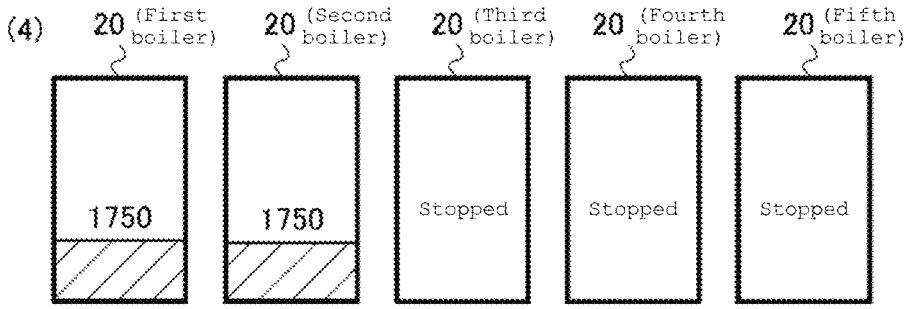
FIGS. 5(4) and 5(5) are schematic views exemplifying operation of the boiler system.
Figure 5:
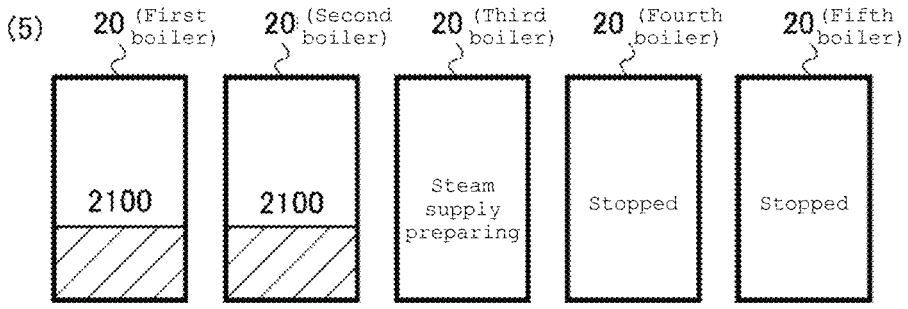

In FIG. 5(4), the second boiler in the steam supply preparing state starts combustion, and the number of the combusted boilers 20 is thus increased. Due to the increase of the number of the combusted boilers 20, the load factors of the combusting boilers 20 are decreased to be lower than the increase minimum load factor. In FIG. 5(4), the total reserve steam flow (10500 kg/h) of the combusting first and second boilers is not less than the varied steam flow. Reserve power corresponding to the varied steam flow is secured in this state and the combustion stopped boilers 20 are not required to shift to the steam supply preparing state.

When the necessary steam flow is subsequently increased in accordance with a required load, the load factors of the combusting first and second boilers are increased so that the output steam flow follows the necessary steam flow. The first and second boilers are each combusting at the load factor of 30% in FIG. 5(5). The total reserve steam flow (9800 kg/h) of the combusting first and second boilers is less than the varied steam flow but the load factor is less than the increase minimum load factor in this case. The controller 4 does not increase the number of the combusted boilers 20.

Reserve power corresponding to the varied steam flow is not secured. When the state depicted in FIG. 5(5) lasts for a predetermined period, the controller 4 shifts the boiler 20 of the highest priority level out of the combustion stopped boilers 20 to the steam supply preparing state. In FIG. 5(5), the controller 4 shifts the third boiler from the combustion stopped state to the steam supply preparing state so as to secure reserve power corresponding to the varied steam flow.

Figure 6:
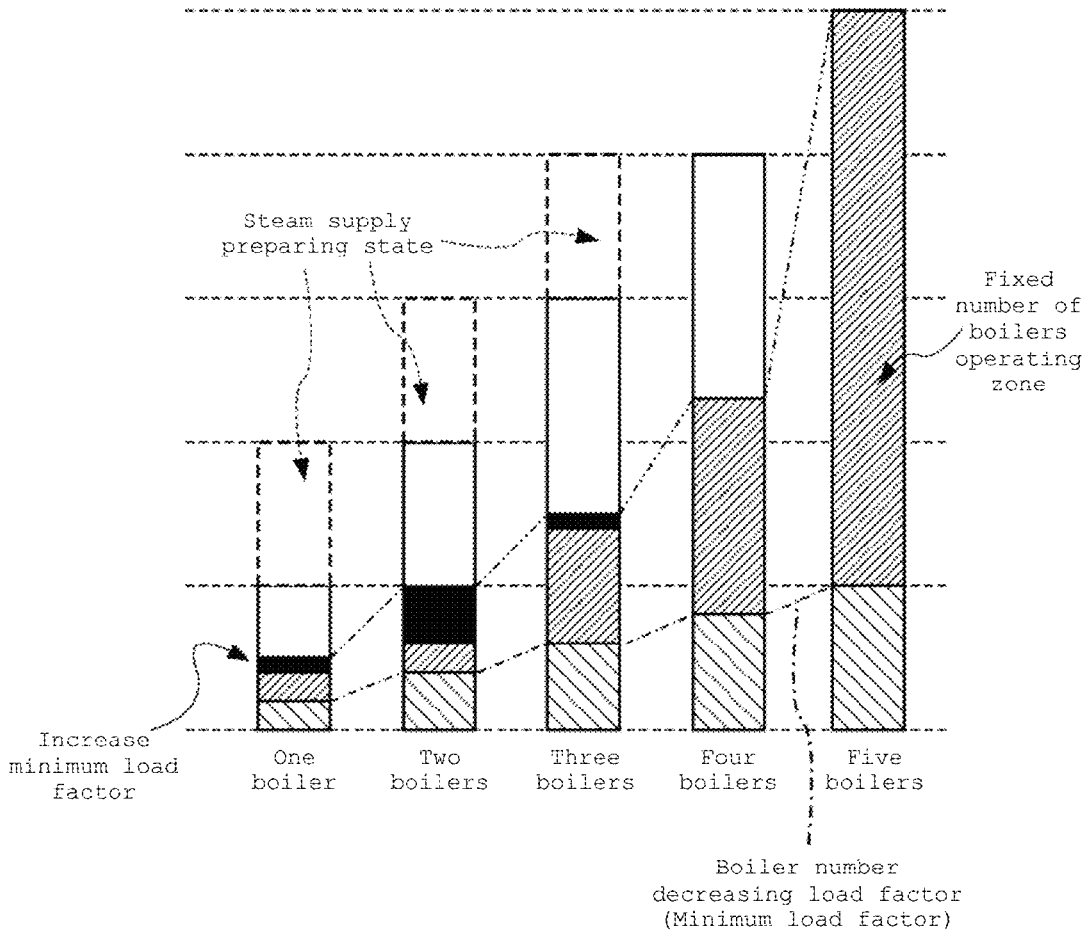
FIG. 6 is a schematic view of a combustion state of the boiler group in the operation.

Effects exerted by the boiler system 1 according to the present embodiment thus configured are described with reference to FIG. 6.

(1) The controller 4 is configured to increase the number of the combusted boilers 20 when the total reserve steam flow of the combusting boilers 20 is not more than the varied steam flow and the load factors of the combusting boilers 20 are not lower than the increase minimum load factor. In this configuration, the number of the combusted boilers 20 is not increased until the load factors become not lower than the increase minimum load factor even if reserve power corresponding to the varied steam flow is not secured. It is thus possible to secure a fixed number of boilers operating zone indicated in FIG. 6. The load factor of the boiler group 2 is controlled continuously in the fixed number of boilers operating zone, so that pressure stability is improved.

Figure 7:
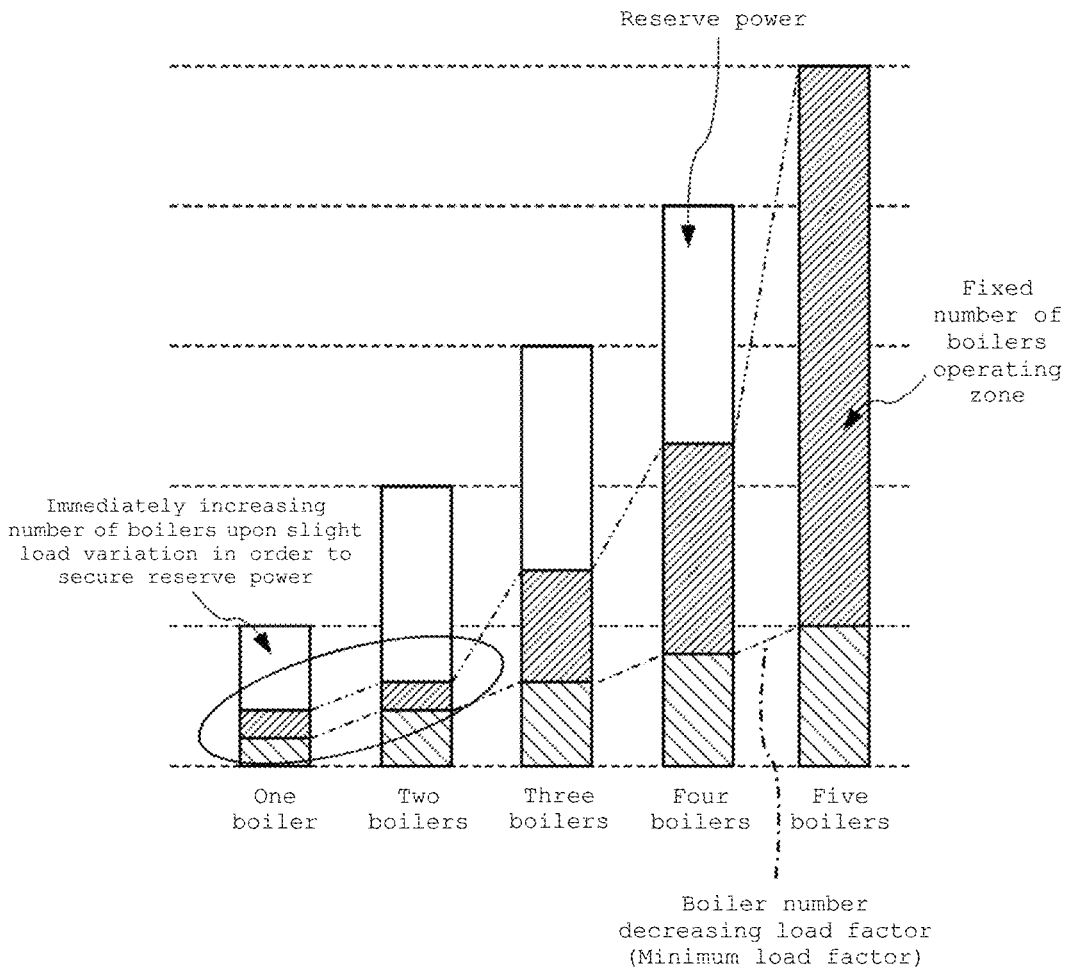
FIG. 7 is a schematic view of a combustion state of a boiler group according to operation of a conventional boiler system.

Even when the number of the combusted boilers 20 is increased in accordance with the increase minimum load factor, there is provided a certain margin from the boiler number decreasing load factor. Specifically, as depicted in FIG. 7, when the number of the combusted boilers 20 is increased from the one or two combusting boilers 20 in the configuration of simply securing reserve power corresponding to the varied steam flow, each of the boilers 20 combusts at the minimum load factor (boiler number decreasing load factor) after the increase of the number. The increased boiler 20 may be stopped shortly depending on a subsequent load variation. In contrast, by delaying the timing of increasing the number of the combusted boilers 20 in accordance with the increase minimum load factor as depicted in FIG. 6, the load factor of each of the boilers 20 upon increase of the number of the combusted boilers 20 has a margin corresponding to the increase minimum load factor from the boiler number decreasing load factor. This configuration prevents the increased boiler 20 from stopping shortly and does not repeat starting and stopping the boiler 20. The boiler system 1 according to the present embodiment can perform continuous control unique to a proportional control boiler and thus improve pressure stability even after increase of the number of the combusted boilers 20.

(2) The controller 4 is also configured to shift, from the combustion stopped state to the steam supply preparing state, the boilers 20 of the number corresponding to the difference between the varied steam flow and the total reserve steam flow when the total reserve steam flow becomes not more than the varied steam flow before the load factors of the combusting boilers 20 become not lower than the increase minimum load factor.

This configuration prevents the boiler 20 from starting and stopping repeatedly as well as secures reserve power for a sudden load variation or temporary increase of a necessary steam flow, thereby to improve pressure stability.

The boiler system 1 according to each of the preferred embodiments of the present invention is described above. The present invention is not limited to the above embodiments but can be modified where appropriate.

For example, the present invention is applied to the boiler system provided with the boiler group 2 including the five boilers 20 according to the present embodiment. The present invention is not limited to this case. Specifically, the present invention is applicable to a boiler system provided with a boiler group including two to four boilers or at least six boilers.

The boilers 20 according to the present embodiment are configured as the proportional control boilers such that the change of the combustion state of the each of the boilers 20 between the combustion stopped state S0 and the minimum combustion state S1 is controlled by performing/stopping combustion of the boiler 20 and the combustion amount can be controlled continuously in the range from the minimum combustion state S1 to the maximum combustion state S2. The present invention is not limited to this case. Specifically, the boilers can be each configured as a proportional control boiler of which combustion amount can be controlled continuously in the entire range from the combustion stopped state to the maximum combustion state.

An output steam flow of the boiler group 2 corresponds to the sum of steam flows from the plurality of boilers 20 in the present embodiment. The present invention is not limited to this case. Specifically, the output steam flow of the boiler group 2 can alternatively correspond to the sum of commanded steam flows as steam flows calculated from combustion command signals transmitted from the boiler number control device 3 (controller 4) to the plurality of boilers 20.

REFERENCE SIGN LIST

1 Boiler system
2 Boiler group
20 Boiler
4 Controller
41 Reserve power calculator
42 Load factor calculator
43 Boiler number controller
431 Boiler increase determiner
432 Reserve power securing unit
U Unit steam flow

The invention claimed is:

1. A boiler system comprising a boiler group including a plurality of boilers configured to combust at continuously changing load factors, and a controller for controlling a combustion state of the boiler group in accordance with a required load, wherein the boiler group has a varied steam flow set to indicate reserve power corresponding to expected increase of a steam flow due to a sudden variation of the required load, and an increase minimum load factor set to indicate a load factor for output of a steam flow corresponding to the required load only from the combusting boilers with no increase of combusted boilers, the controller includes a reserve power calculator for calculating, as a reserve steam flow, a difference between a maximum steam flow and an output steam flow for each of the combusting boilers out of the plurality of boilers and calculating, as a total reserve steam flow, a sum of the reserve steam flows thus obtained, a load factor calculator for calculating the load factor of each of the combusting boilers out of the plurality of boilers, and a boiler number controller for increasing the number of the combusted boilers when the total reserve steam flow calculated by the reserve power calculator is not more than the varied steam flow and the load factor calculated by the load factor calculator is not lower than the increase minimum load factor.

2. The boiler system according to claim 1, wherein the boiler number controller shifts, from a combustion stopped state to a steam supply preparing state, the boilers of the number corresponding to a difference between the varied steam flow and the total reserve steam flow when the total reserve steam flow becomes not more than the varied steam flow before the load factor of each of the combusting boilers becomes not lower than the increase minimum load factor.

* * * * *